United States Patent [19]

Lydiksen

[11] 4,000,765

[45] Jan. 4, 1977

[54] BOTTOM-UP CONTAINER-FILLING MACHINE

[75] Inventor: George C. Lydiksen, Pleasanton, Calif.

[73] Assignee: Simplex Filler Co., Hayward, Calif.

[22] Filed: Jan. 8, 1976

[21] Appl. No.: 647,587

[52] U.S. Cl. ..... 141/181; 141/266

[51] Int. Cl.[2] ..... B67C 3/02

[58] Field of Search ... 141/181, 182, 172, 148–152, 141/253, 260, 263, 264, 270, 275–278, 374, 311 A, 266

[56] References Cited

UNITED STATES PATENTS 3,056,436 10/1962 Fechheimer et al. ..... 141/363

*Primary Examiner*—Houston S. Bell

*Attorney, Agent, or Firm*—Phillips, Moore, Weissenberger, Lempio & Strabala

[57] ABSTRACT

A container-filling machine having a cut-off valve positioned above the container to be filled and a retractable filler spout movable down through said valve to the bottom of the container.

10 Claims, 3 Drawing Figures

BOTTOM-UP CONTAINER-FILLING MACHINE

BACKGROUND OF THE INVENTION

This invention relates to container-filling machines of the type wherein a metered amount of liquid material is discharged downwardly from a filling spout into an open-topped container.

Machines of this type typically have a fixed filler spout and a conveyor mechanism for bringing a container to the spout so that the container may be filled. When the liquid material is of a non-foaming character, the container can be positioned so that its open top is below the bottom end of the spout and the material can be discharged from the spout into the container with little difficulty. In such case, since the spout is completely above the container, a valving mechanism and valve operator therefor can be mounted at the lower end of the spout to prevent drips after a container has been filled and during the time that a new, empty container is being moved into place to be filled.

Many liquid materials, however, are of such nature that the discharge of the material from the elevated spout into the container will cause the material to foam during the filling operation. If the foaming is sufficiently severe it will be difficult or impossible to fill the container with the desired amount of the liquid.

In order to prevent such foaming, container-filling machines are provided with an elevator table below the filler spout. The conveyor mechanism brings a container to the elevator table and positions the open top of the container beneath the spout. The elevator table then raises the container relative to the fixed spout so that in effect the spout descends down into the container until the bottom end of the spout is closely adjacent the bottom of the container. The material may then be discharged from the spout with minimum agitation and foaming. After filling, the elevator table lowers the filled container back down below the spout so that it can be removed and a new container can be brought into place.

Since it is necessary for this bottom-up filling method that the spout be inserted within the container, space and contamination considerations prevent the use of the conventional valve and valve actuator at the bottom of the spout. Operation with an elevator table and without a cut-off valve on the bottom of the spout has been acceptable for heavy, viscous materials such as spackling paste, mayonnaise or similar products that will hold in the spout due to its thickness or viscosity. Such operation, however, is not very satisfactory for filling with thin materials of low viscosity since some of such material will drain from the open bottom of the spout during the time that the filled container is being removed and the new container is being brought into place. Such drainage will cause contamination of the conveyor and containers. In some instances the contamination may be simply an undesirable nuisance. In other instances, such as where poisonous or corrosive materials are being handled, such drippage cannot be tolerated.

SUMMARY OF THE INVENTION

The present invention provides a container-filling machine wherein a bottom-up fill can be accomplished with thin, low-viscosity materials without drip hazard between successive filling operations.

In general, a drip cut-off valve is disposed above the conveyor so that a container can be disposed beneath the valve. When the container is properly positioned, the valve is opened and a vertical filler spout is moved down through the valve so that the lower end of the spout is positioned adjacent the bottom of the container. After filling, the spout is retracted upwardly through the cut-off valve and the valve is then closed. Any drippage from the lower end of the spout will be prevented by the cut-off valve from escaping during the transfer of the filled container from the filling station and the transfer of the next unfilled container to the filling station.

Since only the filler spout itself is inserted into the container a relatively large-size spout may be used to increase fill speed and reduce agitation of the product.

Other advantages of the invention will become apparent in the course of the following detailed description.

BRIEF DESCRIPTION OF THE DRAWINGS

In the drawings, wherein like parts are identified by like reference numerals throughout the same.

DESCRIPTION OF THE PREFERRED EMBODIMENT

Figure 1:
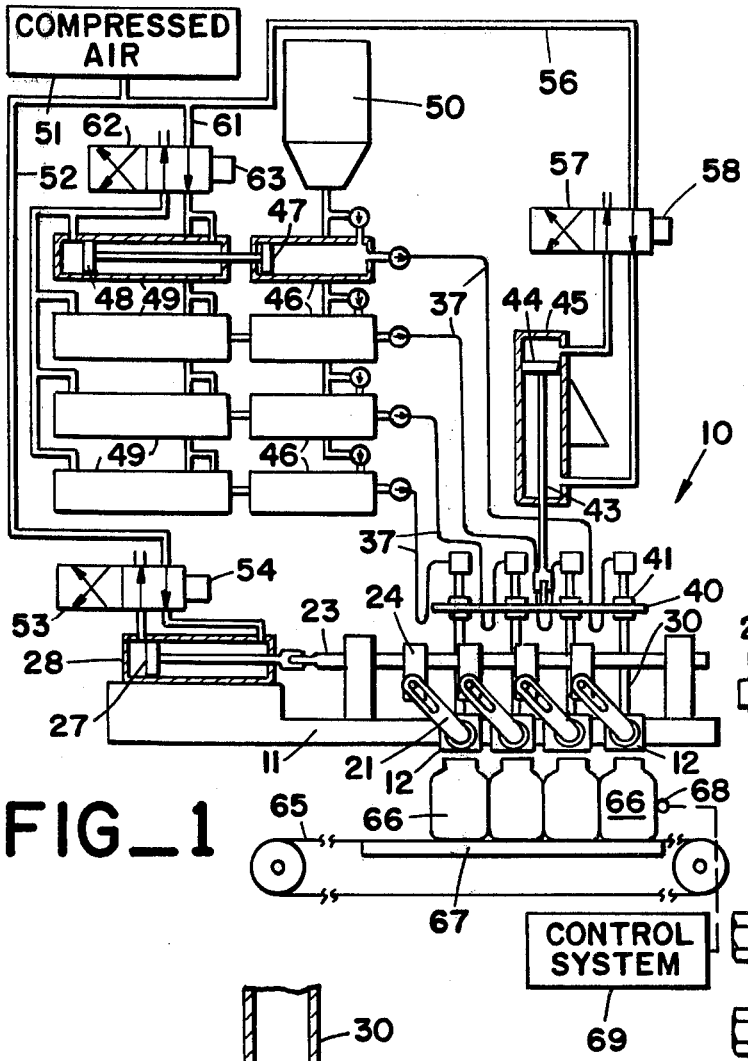
FIG. 1 is an elevational and somewhat schematic illustration of a container-filling machine embodying the present invention.

Referring now to the drawings, wherein is illustrated a preferred embodiment of the invention, the container-filling machine 10 includes a frame 11 on which a plurality of cut-off valve housings 12 are fixedly mounted by screws 13. Each screw passes through a horizontal slot 14 in the frame so that the valve housings can be horizontally spaced from each other by a desired amount. Each valve housing has aligned upper and lower openings 15 and 16 and a cylindrical valve plug 17 therein, the valve plug having a radial bore 18 therethrough and being rotatable in the housing between a position as in FIG. 3 wherein the bore 18 is in full alignment with the housing openings 15 and 16 to provide an unobstructed vertical passage through the valve housing and a position as in FIG. 2 wherein the body of the valve plug completely blocks the housing openings. Axial movement of the plug in the housing is prevented by keeper plate 19 which is secured to the housing and projects into a circumferential groove 20 on the plug. A valve-operating lever 21 is fixed to an end of the plug and extends radially therefrom, the lever having an elongated slot 22. A reciprocating bar 23 has a plurality of valve actuators 24 fixed thereto, as by set screw 25, each actuator having a pin 26 received in the slot 22 of one of the levers 21, so that reciprocation of bar 23 will cause all of the valve plugs to rotate simultaneously between the positions illustrated in FIGS. 2 and 3. Bar 23 is reciprocated by the action of piston 27 in cylinder 28.

Each valve housing 12 has an elongated tubular filler spout 30 extending downwardly into the upper opening 15 of the valve housing, the spout being supported in a packing member 31 comprising upper and lower collars 32 and 33 and a plurality of washers 34 therebetween which can compress against the exterior spout to a degree determined by the degree that the collars 32 and 33 are tightened together. The lower packing collar 33 fits into a complimentary shaped bore in the housing member and is held in place as by retainer bars 35. Removal of the retainer bars 35 allows the spout and packing member to be removed as a unit from the valve housing for cleaning or replacement. The upper end of each filler spout is provided with a nipple 36 to which a flexible hose 37 may be secured by a conventional band clamp 38.

Figure 2:
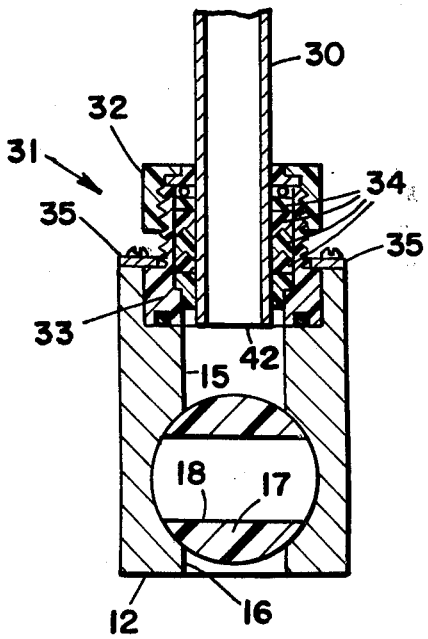
FIG. 2 is a sectional view through a cut-off valve showing the filler spout retracted and the cut-off valve closed.
Figure 3:
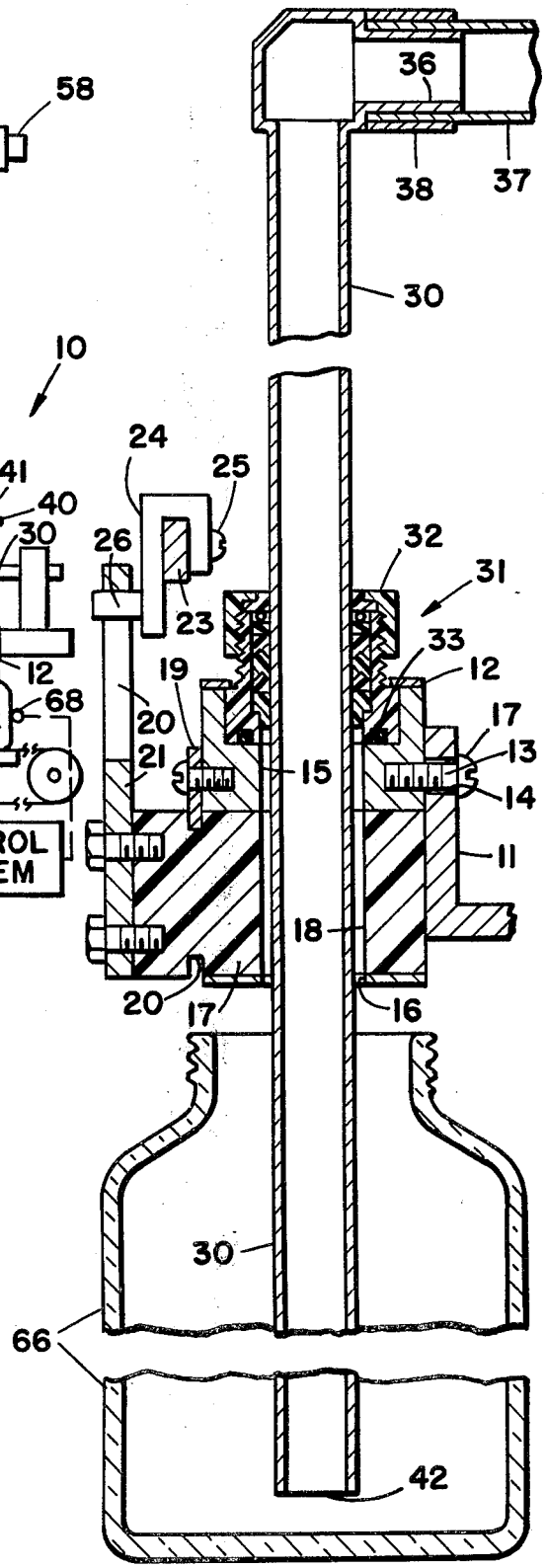
FIG. 3 is a sectional view through a cut-off valve, at 90° to FIG. 2, showing the cut-off valve open and the filler spout extending downwardly therethrough to the bottom of a container.

The filler spouts are each secured to a horizontal actuating bar 40 by adjustable lock collars 41 so that upward movement of bar 40 will move the filler spouts simultaneously upwardly to a position as in FIG. 2 wherein the lower end 42 of each spout is above the valve plug 17 and so that downward movement of bar 40 can move all of the filler spouts so that the lower ends 42 of the spouts will pass simultaneously through the valve plug bores 18 and lower valve housing openings 16 to a position substantially therebelow, as in FIG. 3. Bar 40 is secured to piston rod 43 and the degree of vertical movement of the filler spouts will be determined by the length of the stroke of the piston 44 in cylinder 45.

Each hose 37 is connected to a metering cylinder 46 having a piston 47 therein which is reciprocated by movement of piston 48 in cylinder 49. As all pistons 47 and 48 move leftwardly, fluid from supply hopper 50 will be drawn into the metering cylinders. Movement of the pistons to the right will then force the fluid out of the metering cylinders to the hoses 37.

The various operating cylinders are supplied with compressed air from a suitable pressure source 51. Line 52 connects the compressed air from source 51 to valve 53 which is reciprocated by solenoid operator 54 to deliver fluid pressure to either the rod or head end of cylinder 28, the opposite end of the cylinder being exhausted through the valve. Similarly, line 56 connects the output of pump 51 through valve 57 to cylinder 45, with solenoid 58 controlling the position of valve 57 to deliver pressure fluid to either the rod or head end of that cylinder. Line 61 supplies fluid under pressure through valve 62 simultaneously to each cylinder 49, with solenoid 63 controlling valve 62 so that pressure fluid will be supplied to the rod or head ends of these cylinders as desired.

A suitable conveyor 65 is provided to move open-topped containers 66 horizontally to the filling station, below the valve housings 12, the conveyor being supported, as by fixed base plate 67, at the filling station so that the valve housings 12 are at a fixed distance above the conveyor and the containers thereon as the containers are filled. An indexing device, represented in the drawings by probe 67, will sense the presence of the containers at the filling station and will actuate a conventional control system 69 which controls horizontal movement of the containers and causes the desired sequential operation of the solenoids 54, 58 and 63.

In operation of the machine 10, the valve housings 12 are first adjusted on frame 11 so that the valve housings and spouts 30 are spaced apart horizontally the proper distance for the particular size containers to be filled. The valve actuators 24 are similarly spaced and secured to bar 23. Control system 69 causes the conveyor 65 to move containers to the filling station, and actuates solenoid 63 so that pistons 47 and 48 move to left to charge the metering cylinders 49 with fluid. When containers 66 have been moved so that there is one container beneath each filler spout, the control system will cause the containers to be held against forward movement during filling. Solenoid 54 will be actuated to cause pressure fluid to be admitted to the head end of cylinder 28, moving piston 27 and bar 23 to the right so that the valve plugs 15 are rotated 90° to the full open position shown in FIG. 3. Solenoid 58 is then actuated so that pressure fluid is delivered to the head end of cylinder 45 causing all of the filler spouts 30 to descend through the valve housings so that their lower ends 42 are near the bottoms of containers 66. Solenoid 63 is now actuated so that fluid pressure is supplied to the head ends of cylinders 49, causing the fluid in the metering cylinders to be fed through hoses 37 to the filling spouts and thus to the bottoms of the containers. If desired, control system 69 can now deenergize solenoid 58 so that valve 57 returns to its illustrated position, causing the filler spouts to be moved upwardly during filling of the containers so that the bottoms of the spouts are maintained at the level of the liquid in the containers. At the end of the filling operation, the spouts are retracted to the position shown in FIG. 2. During retraction of spouts 30, the packing members 31 will strip off any liquid adhering to the exterior of the spouts. At this time, control system 69 causes solenoid 54 and valve 53 to supply fluid pressure to the rod end of cylinder 28 so that the valve plugs are rotated back 90° to closed position, sealing off the bottom openings of valve housings 25 so that no drippage will occur. Control system 69 will now cause conveyor 65 to move the filled containers from the filling station while bringing new containers thereto and will cause the metering cylinders 46 to be recharged so that another filling cycle can commence.

What is claimed is:

1. A container-filling machine comprising:

a. conveyor means for moving an open-topped container horizontally to and away from a filling station at said filling machine and for holding said container against horizontal or vertical movement while at said filling station and during a filling operation, b. a housing member mounted at said filling station a fixed distance above said conveyor means, said housing member having aligned upper and lower openings, c. a valve member having a fill opening therethrough and being operatively associated with said housing member and movable relative thereto between a first position wherein said lower housing member opening is unobstructed and a second position wherein said lower housing member opening is blocked, d. a vertically disposed and vertically movable elongated tubular spout extending downwardly into said upper housing member opening, said spout being vertically movable between a first position wherein the lower end of said spout is above said lower housing member opening and a second position wherein the lower end of said spout extends through said valve fill opening and substantially below said lower housing member opening, e. means for moving said valve member between its first and second positions when said spout is in its first position, f. means for moving said spout between its first and second position when said valve member is in its first position, g. means for forcing a measured quantity of fluid through said spout when said valve member is in its first position.

2. A container-filling machine as set forth in claim 1 and further including packing means mounted on said housing member for sealing the exterior of said tubular spout to the upper housing member opening and for supporting said tubular spout in vertical position and for allowing vertical movement of said tubular spout relative to said housing member.

3. A container-filling machine as set forth in claim 1 wherein said valve member comprises a cylindrical valve plug rotatably disposed in said housing member between said upper and lower openings, said valve plug having a radial bore therethrough movable into and out of alignment with said upper and lower openings.

4. A container-filling machine as set forth in claim 3 and further including packing means mounted on said housing member for sealing the exterior of said tubular spout to the upper housing member opening while allowing vertical movement of said tubular spout relative to said housing member.

5. A container-filling machine, comprising a. conveyor means for moving a plurality of open-topped containers along a horizontal path to and away from a filling station at said filling machine and for positioning said plurality of containers and holding said containers against horizontal and vertical movement at said filling station and during a filling operation, b. a plurality of housing members mounted at said filling station and spaced along said path, each housing member being mounted a fixed distance above said conveyor means and having aligned upper and lower openings, c. a plurality of valve members one for each housing member, each valve member having a fill opening therethrough and being operatively associated with a housing member and movable relative thereto between a first position wherein the lower housing member opening is unobstructed and a second position wherein said lower housing member opening is blocked, d. a plurality of vertically disposed and vertically movable spouts, one for each housing member, each spout extending downwardly into said housing member opening and being movable between a first position wherein the lower end of said spout is above said lower housing member opening and a second position wherein the lower end of said spout extends through said valve member fill opening and said lower housing member opening and substantially below said housing member, e. means for moving said valve members simultaneously between their first and second positions when said spouts are all in their first positions, f. means for moving said spouts simultaneously between their first and second positions when said valve members are all in their first positions, g. means for forcing a measured quantity of fluid simultaneously through each of said spouts when said valve members are all in their first positions.

6. A container-filling machine as set forth in claim 5 and further including means for adjusting the horizontal spacing between said housing members.

7. A container-filling machine as set forth in clai 5 and further including packing means mounted on each said housing member for sealing the exteriors of said tubular spouts to the upper housing member openings while allowing vertical movement of said tubular spouts relative to said housing members.

8. A container-filling machine as set forth in claim 5 wherein each of said valve members comprises a cylindrical valve plug rotatably disposed in the housing member with which said valve member is associated and between said upper and lower openings, said valve plugs each having a radial bore therethrough movable into and out of alignment with said upper and lower passages.

9. A container-filling machine as set forth in claim 8 and further including packing means mounted on each said housing member for sealing the exteriors of said tubular spouts to the upper housing member openings while allowing vertical movement of said tubular spouts relative to said housing members.

10. A container-filling machine as set forth in claim 9 and further including means for adjusting the horizontal spacing between said housing members.

* * * * *